US006752350B2

(12) United States Patent
Robards

(10) Patent No.: US 6,752,350 B2
(45) Date of Patent: Jun. 22, 2004

(54) COMPOSITE REEL APPARATUS

(75) Inventor: Thomas H. Robards, Highland, IL (US)

(73) Assignee: Stone Container Corporation, Chicago, IL (US)

( * ) Notice: Subject to any disclaimer, the term of this patent is extended or adjusted under 35 U.S.C. 154(b) by 156 days.

(21) Appl. No.: 09/923,643

(22) Filed: Aug. 4, 2001

(65) Prior Publication Data

US 2002/0038839 A1 Apr. 4, 2002

Related U.S. Application Data

(63) Continuation of application No. 09/320,862, filed on May 27, 1999, now abandoned.

(51) Int. Cl.[7] ..... B65H 75/14
(52) U.S. Cl. ..... 242/608.3; 242/610.4
(58) Field of Search ..... 242/608.3, 610, 242/610.4, 614.1, 118.61, 118.7

(56) References Cited

U.S. PATENT DOCUMENTS 3,266,749 A 8/1966 Christian et al. ..... 242/118.7
3,584,819 A 6/1971 Brough ..... 242/118.61
3,620,471 A 11/1971 Hubbard et al. ..... 242/118.6
4,412,661 A 11/1983 Wise et al. ..... 242/77.4
5,509,620 A 4/1996 Crews ..... 242/608
5,520,982 A 5/1996 Grigsby et al. ..... 428/76
5,667,620 A 9/1997 Grigsby et al. ..... 156/254

*Primary Examiner*—John Q. Nguyen
(74) *Attorney, Agent, or Firm*—Greenberg Traurig LLP

(57) ABSTRACT

A rotatable composite reel apparatus for use in association with an axle for winding, storing, transporting and unwinding various windable materials therewith, including a tubular spindle member and first and second composite platform members, held together by one or more straps passing through aligned apertures in the first and second composite platform members. At least one of the first and second platform members is fabricated at least in part, from a high-density composite fiberboard and perpendicular corrugated paperboard material. Corrugated paperboard material is also employed in the construction of at least one of the first and second platform members.

11 Claims, 2 Drawing Sheets

COMPOSITE REEL APPARATUS

This application is a continuation of application Ser. No. 09/320,862, filed May 27, 1999, now abandoned.

BACKGROUND OF THE INVENTION

1. The Technical Field

The present invention relates to rotatable reel apparatus for containing, storing and transporting wire, cord, tubing and the like. In particular, the invention is directed to reels, spools and/or drums for the transportation of extended lengths of filament or tubing materials.

2. The Prior Art

Reels, constructed for use in cooperation with an axle passing therethrough, to permit rotation of the reel for the take-up or release of filament or tubing wound on the reel, are known in the art. Typically, such prior art reels have been constructed from relatively rigid materials, such as plastic, wood and/or steel, wherein the platforms of the reels are molded with, nailed to or welded to the central tube, around which the windable material is actually wound. Although such prior art reels function as intended with respect to the storage and handling of the wire, cord, tubing, etc., typically such reels are relatively heavy, and relatively expensive both with respect to manufacturing costs, and repair and replacement costs. In addition, such reels have had relatively poor recyclability characteristics.

Rotatable reel apparatus, fabricated in whole or in part, from corrugated paperboard material, are also found in the prior art. One such prior art reel apparatus is disclosed in Crews, U.S. Pat. No. 5,509,620. The Crews '620 patent discloses a rotatable reel apparatus fabricated substantially entirely from corrugated paperboard material. A cylindrical tube is sandwiched between two platform members. Each of the platform members is attached by adhesive to the cylindrical tube through trapezoidal tabs punched from and bent inwardly from each of the platform members. These trapezoidal tabs are glued to inner and/or outer surfaces of the cylindrical tube, for permanent affixation of the platform members to the cylindrical tube. Stone Container Corporation continues to market the rotatable reel apparatus, having this construction, under the trademark CorReel.

Being fabricated substantially entirely of corrugated paperboard material, the CorReel rotatable reel apparatus is highly recyclable and of extreme lightweight. However, the load carrying capacity of the CorReel rotatable reel apparatus is limited, inasmuch as a single or perhaps double layer of corrugated material is employed for each platform member.

It would be desirable to provide a reel apparatus fabricated from corrugated paperboard or other paper/fiber based materials, which is easy to handle and has enhanced strength characteristics relative to prior art reel apparatus. This desirable characteristic and others will become apparent in light of the present specification, including claims, and drawings.

SUMMARY OF THE INVENTION

The present invention is directed to a rotatable composite reel apparatus for use in association with an axle for winding, storing, transporting and unwinding various windable materials therewith.

The rotatable composite reel apparatus comprises a tubular spindle member, for receiving and maintaining windable material thereabout. The tubular spindle member has first and second open ends, defined by first and second end edges, respectively.

First and second composite platform members are operably connected to the first and second open ends of the tubular spindle member, respectively, for sandwiching the tubular spindle member, and, in turn, the windable material wound about the tubular spindle member, therebetween. Each of the first and second composite platform members further includes a spindle engagement disk, insertably and respectively received within each of the first and second ends of the tubular spindle member, and a platform disk, substantially concentrically aligned with and affixed to the spindle engagement disk, and further having an outside diameter substantially greater than the outside diameter of the spindle engagement disk.

Each platform disk further includes a first support disk, affixed directly to the spindle engagement disk, which first support disk is fabricated from a high density composite fiberboard and perpendicular corrugated paperboard material.

Each platform disk may also include a second support disk affixed to a side of the first support disk opposite the side to which the spindle engagement disk is attached, the second support disk being fabricated, at least in part, from corrugated paperboard material.

The rotatable composite reel apparatus preferably further comprises means for maintaining the first and second platform members in said operable connection to the first and second open ends of the tubular spindle member. The means for maintaining the first and second platform members in said operable connection to the first and second open ends of the tubular spindle member preferably comprises at least first and second strap apertures disposed in each of the first and second platform members. The first strap aperture of the first platform member is operably aligned with the first strap aperture of the second platform member. The second strap aperture of the first platform member is operably aligned with the second strap aperture of the second platform member. At least one strap member is operably extended through the at least first and second strap apertures of the first and second platform members, tensioned and sealed upon itself, to exert tension upon the first and second platform members tending to pull the first and second platform members toward one another, and axially compressing the tubular spindle member therebetween.

The at least first and second strap apertures preferably further comprise two sets of first and second strap apertures disposed in each of the first and second platform members. Each of the at least first and second strap apertures is preferably positioned at a radial distance from the center of their respective platform member a distance less than the radius of the spindle engagement disk of the respective platform member.

The tubular spindle member may be fabricated from spiral wound paper material, with each successive wrap of paper material being adhesively affixed to the outer surface of the previous wrap.

At least one of the spindle engagement disks may be fabricated from at least two layers of corrugated paperboard material, the flutes of one layer being arranged at an angle relative to the flutes of at least one other layer. Preferably, the at least two layers of corrugated paperboard material in the spindle engagement disk comprise three layers of corrugated paperboard material, the outer layers of corrugated paperboard material having flutes of corrugated medium oriented perpendicular to flutes of corrugated medium of the center layer of corrugated paperboard material.

The rotatable composite reel apparatus may further comprise an elongated slot, disposed in the second support disk of at least one of the first and second platform members, if second support disks are employed, and extending between the at least first and second strap apertures, with edges of the elongated slot defining a recess, so that upon insertion, tensioning and sealing of the at least one strap member, a portion of the at least one strap member is received in the recess, toward precluding extension of the at least one strap member beyond an outwardly facing surface of the second support disk.

The rotatable composite reel apparatus may further comprise, in an alternative embodiment of the invention, an elongated groove disposed in the first support disk of at least one of the first and second platform members, and extending between the at least first and second strap apertures, with edges of the elongated groove defining a recess, so that upon insertion, tensioning and sealing of the at least one strap member, a portion of the at least one strap member is received in the recess, toward precluding extension of the at least one strap member beyond an outwardly facing surface of the second support disk.

The rotatable composite reel apparatus may further comprise an aligned axle receiving aperture disposed in each of the first and second platform members for receiving an axle therethrough for, in turn, enabling rotation of the rotatable composite reel apparatus for winding and unwinding of the windable material.

BEST MODE FOR CARRYING OUT THE INVENTION

Figure 1:
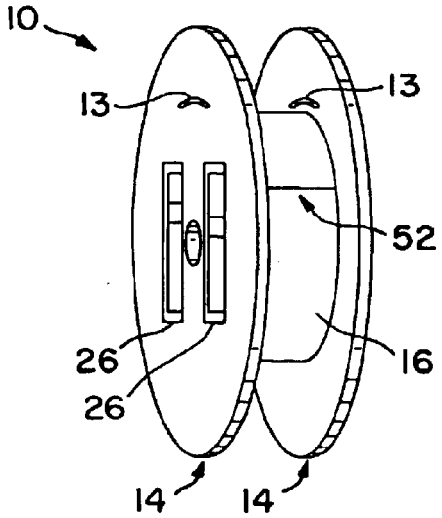
FIG. 1 is a perspective view of an assembled rotatable composite reel apparatus according to a preferred embodiment of the invention.
Figure 2:
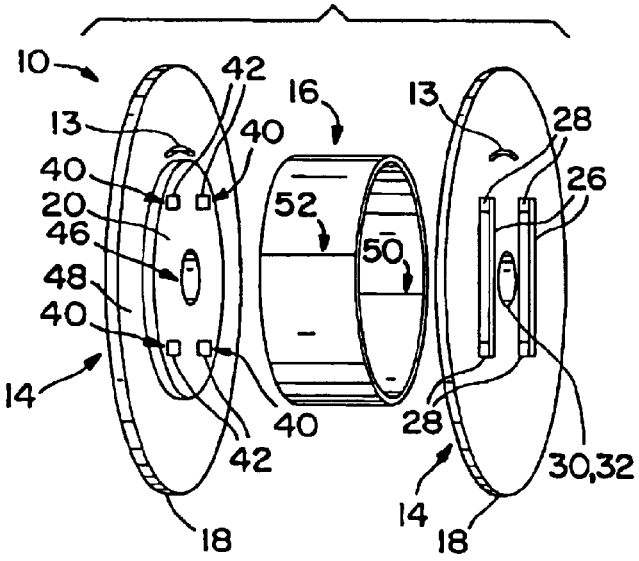
FIG. 2 is an exploded perspective view of the components of the rotatable composite reel apparatus of FIG. 1.
Figure 5:
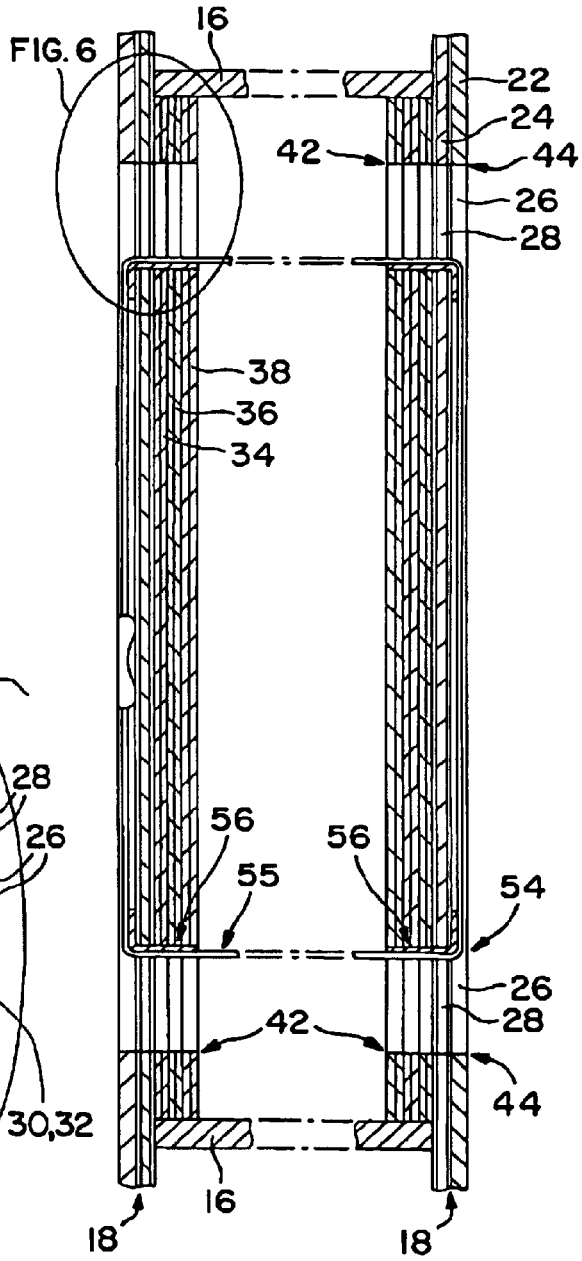
FIG. 5 is an enlarged fragmentary elevation, in section, of the rotatable composite reel apparatus of the present invention, taken along line 5—5 of FIG. 3.
Figure 3:
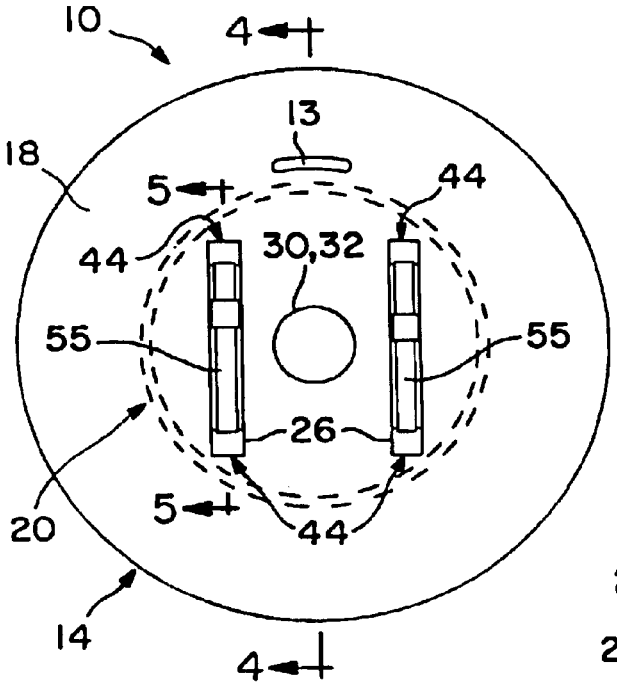
FIG. 3 is a top plan view of the rotatable composite reel apparatus of FIG. 1.
Figure 4:
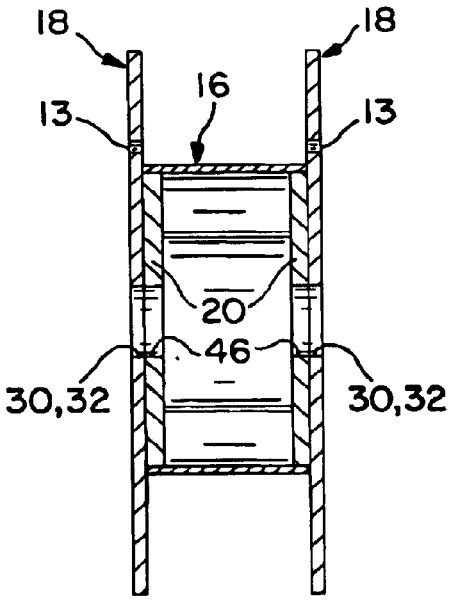
FIG. 4 is an elevation, in section, of the rotatable composite reel apparatus of FIG. 1, taken along line 4—4 of FIG. 3.

While this invention is susceptible of embodiment in many different forms, there are shown in the drawings and will be described in detailed herein, a plurality of embodiments, with the understanding that the present disclosure is to be considered as an exemplification of the principles of the invention, and is not intended to limit the invention to the embodiments illustrated.

FIGS. 1–6 illustrate the composite reel apparatus of the present invention. Reel apparatus 10 includes two platforms 14 and a cylindrical spindle 16. Each platform 14 is formed by a disk 18 and a spindle attachment disk 20.

Each disk 18 is, in turn, fabricated from a circle 22 of single wall (liner board/corrugated medium/liner board) corrugated paperboard material (e.g., 275 lb. C-flute), laminated to a die-cut circle 24 of high-density composite fiberboard and perpendicular corrugated paperboard/perpendicular corrugated paperboard center material (hereinafter sometimes referred to as "composite fiberboard/corrugated material"). See FIG. 6, for further detail. A suitable material is manufactured by North American Container Corporation, and sold under the trademark Fibre-Core, and alternatives of which material are found described in U.S. Pat. Nos. 5,520,982 and 5,667,620. Such a material may be fabricated by laminating together and compressing a plurality of sheets of open-faced double-wall corrugated paperboard material, arranged front-to-back, to form a large billet. The billet is then cut, across the corrugations, to form thin layers of bonded corrugated paperboard material, in which the corrugations extend perpendicular to the plane of the layer. One or more solid fiberboard sheets (e.g., 3 layers of 42 lb. linerboard) are then adhesively affixed to opposite sides of the billet, on the faces of the exposed corrugations, so that the corrugations run perpendicular to the solid fiberboard sheets.

One or both of disks 18 may have an arcuate slot 13 extending therethrough, beyond the radius of tubular spindle member 16, for passing and securing an end of the windable material to preclude inadvertent unwinding of same.

Two elongated rectangular slots 26 are formed in each circle 22, substantially symmetrically disposed about the center of circle 22. See FIG. 2. Four shorter rectangular or square apertures 28 are formed in each circle 24, substantially symmetrically about the center of circle 24, such that three sides of each aperture 28 are substantially aligned with an end edge and adjacent portions of the side edges of one of slots 26.

Central axle apertures 30 in disks 22 are substantially concentrically aligned with central axle apertures 32 in disks 24. See FIG. 4. Apertures 30, 32 permit the passage of an axle through apertures 30, 32, in a completed reel apparatus 10, to, in turn, permit winding and unwinding of windable material onto and off of reel 10.

Figure 6:
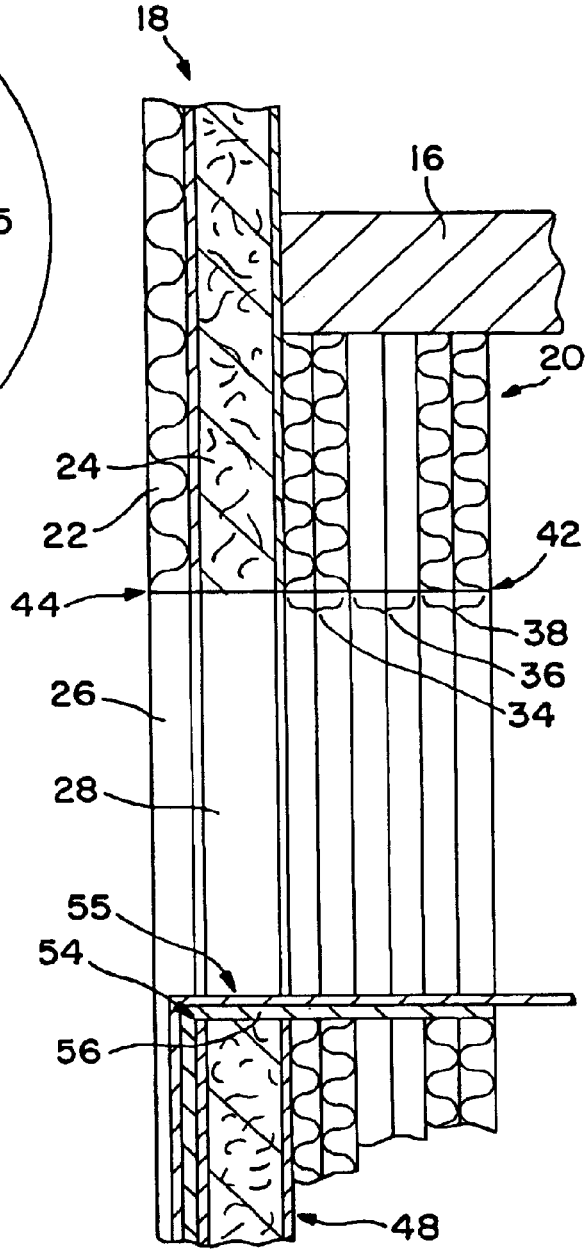
FIG. 6 is an enlarged view of the circled portion of FIG. 5.

Each of disks 20 is preferably fabricated from three circles 34, 36 and 38, of corrugated paperboard material (FIG. 6). For example, each circle 34, 36, 38, preferably may be fabricated from 350 lb. "BC" doublewall corrugated paperboard material. Doublewall corrugated paperboard is fabricated from successive layers of linerboard, corrugated medium, linerboard, corrugated medium and linerboard. For enhanced strength, each of the three circles 34, 36 and 38 of disk 20 are glued to one another with, for example, the flutes of circles 34 and 38 extending parallel to one another, with the flutes of circle 36 oriented perpendicular to the flutes of circles 34 and 38.

Alternatively, other relative orientations (such as a mutual 120° deflection) of the flutes of the three circles may be employed. In addition, a greater or lesser number of layers of circles of corrugated paperboard medium may be employed as desired or prompted by the requirements of any particular application. Further, the composition and construction of each of the circles in the disk 20 may be varied according to the economic and technical requirements of any given application. For example, for smaller or lighter weight applications, single wall corrugated paperboard may be used as a substitute for one or more of the circles. For larger or heavier duty applications, triplewall corrugated or higher order corrugated paperboard materials may be used as a substitute for one or more of the circles making up disk 20.

Four rectangular (preferably square) apertures 40 are situated in disk 20 (FIGS. 2, 5, 6), passing through all of the circles of corrugated paperboard material. Each of rectangular apertures 40 is positioned in disk 20 so that, for example, the outer end edges 42 of each of apertures 40 align with the outer edges of apertures 28, both of which align with end edges 44 of slots 26 in disks 22. In addition, central circular aperture 46 is provided in each of disks 20, and aligned with apertures 30/32 of disks 22, when disk 20 is affixed, such as by gluing, to the exposed face 48 of disk 24.

Tubular spindle member 16 (FIGS. 1, 2) is preferably fabricated from spiral wound paper material, such as tube chip sheet paper material, as such material is known by those of ordinary skill in the art. Each successive wrap of material is affixed to the outer surface of the previous wrap layer by adhesive to form an axially rigid tube, with inner and outer seams 50 and 52. The inner diameter of tubular spindle member 16 may be the same or slightly larger than the outside diameter of disks 20, so that a forced fit between tubular spindle member 16 and disks 20 is obtained, when tubular spindle member 16 is forced onto disks 20.

After each of platforms 14 has been fully assembled, tubular spindle member 16 is placed onto a bottom platform 14 so that the bottom end of tubular spindle member 16 is forced onto and over disk 20 of bottom platform 14. A second upper platform 14 is then placed atop tubular spindle member 16 with disk 20 of the second platform 14 fitting into the open upper end of tubular spindle member 16. Metal or plastic straps 55 are then passed through aligned corresponding openings 28, 40. Straps 55 are then tensioned and sealed to pull disks 20 of opposing platforms 14 toward one another, placing tubular spindle member 16 in compression. In order to reduce strap damage to the inside edges 54 of apertures 40, angle board members 56 may be placed in each of apertures 40 and glued in place, against the inside edges 54 of apertures 40, prior to placement of straps 55, so that straps 55 contact angle board 56, rather than crushing the exposed edge faces of the corrugated paperboard material. Each angle board member 56 is preferably fabricated from one or more layers of heavy gauge paperboard or cardboard materials.

When reel 10 is fully assembled, the straps are received in the recesses defined by the interfaces between slots 28 in disks 22 (FIGS. 5 and 6), and the outer surfaces of disks 20, between apertures 40. In this manner, the straps preferably do not project "above" the outer surfaces of disks 22. This permits an assembled reel to be laid on its side, with the outer surface of the bottom disk 22 lying flat on a floor or other horizontal surface. The recessed position of the strap in the bottom platform, means that damage to the floor or other horizontal support surface is less likely, and there is reduced likelihood of snagging of the straps, upon sliding of a reel across a floor or other horizontal support surface.

The construction of FIGS. 1–6 employs composite platform members, with first support disks of composite fiberboard/corrugated material, and second support disks of otherwise conventional corrugated paperboard. As an alternative construction, platform members, using only first support disks made of the composite fiberboard/corrugated material, may be used. In the alternative embodiment, in addition to the two pairs of strap apertures 40, described in detail hereinabove, shallow rectangular grooves may be provided on the outwardly-facing surfaces of the composite fiberboard/corrugated material disks, extending between paired strap apertures. The grooves between pairs of strap apertures would serve the same function of providing recesses for the respective straps, which the slots 26 of disks 22 served in the embodiment previously described.

An advantageous feature which the present invention is believed to possess is that the components (platforms 14 and tubular spindle member 16) of reel apparatus 10, once fabricated, are amenable to handling by automated handling equipment, which can retrieve the component parts (platforms and tubular spindle member) from different stacks, assemble them, and while holding them together, pass straps through the aligned strap apertures, and tension and seal the straps, to create a finished reel apparatus. Such amenability to automated handing and assembly is believed to be a feature not present in prior art reel apparatus, particularly prior art reel apparatus fabricated from recyclable paper, paperboard and corrugated paperboard materials.

An additional advantageous feature is that the reel may be broken down by simply cutting and removing the straps, to return the reel apparatus into its separate component parts, which may be more easily packaged and stored for transportation for reuse.

Yet another advantageous feature of the present invention is the use of high-density composite fiberboard/corrugated material for the platform members. For a reel apparatus having a platform diameter of approximately three and one-half feet, a tubular spindle member length of approximately nine inches and diameter of approximately two feet, and employing platforms with composite fiberboard/corrugated material layers employing the Fibre-Core-style composite fiberboard/corrugated material having a thickness of approximately three-eighths of an inch, it is believed that a load of approximately four hundred pounds or more of windable material may be accommodated. Comparable prior art reel apparatus are believed to be limited to approximately two hundred fifty pounds of windable material.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A rotatable composite reel apparatus for use in association with an axle for winding, storing, transporting and unwinding various windable materials therewith, the rotatable composite reel apparatus comprising:

a tubular spindle member, extending parallel to and circumferentially surrounding an axis of rotation of the rotatable composite reel apparatus, for receiving and maintaining windable material thereabout;

the tubular spindle member having first and second open ends, defined by first and second end edges, respectively;

first and second composite platform members, operably connected to the first and second open ends of the tubular spindle member, respectively, for sandwiching the tubular spindle member, and, in turn, the windable material wound about the tubular spindle member, therebetween, the first and second composite platform members being disposed substantially perpendicular to the axis of rotation of the rotatable composite reel apparatus;

each of the first and second composite platform members further including a spindle engagement disk, insertably and respectively received within each of the first and second ends of the tubular spindle member for supporting the spindle member, and a platform disk, substantially concentrically aligned with and affixed to the spindle engagement disk;

each platform disk further including a first support disk, affixed directly to the spindle engagement disk, the first support disk being fabricated from a high density composite fiberboard and perpendicular corrugated paperboard material;

at least first and second strap apertures disposed in each of the first and second composite platform members, the first strap aperture of the first composite platform member being operably aligned with the first strap aperture of the second composite platform member, and the second strap aperture of the first composite platform member being operably aligned with the second strap aperture of the second composite platform member; and at least one strap member, operably extended through the at least first and second strap apertures of the first and second composite platform members, and tensioned, to exert tension upon the first and second composite platform members tending to pull the first and second composite platform members toward one another, and axially compressing the tubular spindle member therebetween; and at least one strap aperture protection member, disposed along an inwardly disposed surface of at least one of the at least first and second strap apertures in the first and second composite platform members, for inhibiting damage to the inwardly disposed surface upon placement and tensioning of the at least one strap member.

2. The rotatable composite reel apparatus according to claim 1, wherein each platform disk further comprises a second support disk affixed to a side of the first support disk opposite the side to which the spindle engagement disk is attached, the second support disk being fabricated, at least in part, from corrugated paperboard material.

3. The rotatable composite reel apparatus according to claim 2, further comprising an elongated slot, disposed in the second support disk of at least one of the first and second platform members, and extending between the at least first and second strap apertures, with edges of the elongated slot defining a recess, so that upon insertion, tensioning and sealing of the at least one strap member, a portion of the at least one strap member is received in the recess, toward precluding extension of the at least one strap member beyond an outwardly facing surface of the second support disk.

4. The rotatable composite reel apparatus according to claim 1 further comprising an aligned axle receiving aperture disposed in each of the first and second platform members for receiving an axle therethrough for, in turn, enabling rotation of the rotatable composite reel apparatus for winding and unwinding of said windable material.

5. The rotatable composite reel apparatus according to claim 1, wherein the at least first and second strap apertures further comprise two sets of first and second strap apertures disposed in each of the first and second platform members.

6. The rotatable composite reel apparatus according to claim 1, wherein each of the at least first and second strap apertures is positioned at a radial distance from the center of their respective platform member a distance less than the radius of the spindle engagement disk of the respective platform member.

7. The rotatable composite reel apparatus according to claim 1, wherein the tubular spindle member is fabricated from spiral wound paper material, with each successive wrap of paper material being adhesively affixed to the outer surface of the previous wrap.

8. The rotatable composite reel apparatus according to claim 1, at least one of the spindle engagement disks being fabricated from at least two layers of corrugated paperboard material, the flutes of one layer being arranged at an angle relative to the flutes of at least one other layer.

9. The rotatable composite reel apparatus according to claim 8, wherein the at least two layers of corrugated paperboard material in said spindle engagement disk comprise three layers of corrugated paperboard material, the outer layers of corrugated paperboard material having flutes of corrugated medium oriented perpendicular to flutes of corrugated medium of the center layer of corrugated paperboard material.

10. The rotatable composite reel apparatus according to claim 1, wherein each of the first and second composite platform members has a center of rotation, a peripheral edge region, a first, substantially constant, thickness, in a circular region extending from the center of rotation to a first radial distance from the center of rotation; and a second, substantially constant, thickness, in an annular region extending from the first radial distance from the center of rotation, to the peripheral edge region, wherein the second, substantially constant, thickness is substantially less than the first, substantially constant, thickness.

11. The rotatable composite reel apparatus according to claim 1 further comprising an elongated groove, disposed in the first support disk of at least one of the first and second platform members, and extending between the at least first and second strap apertures, with edges of the elongated groove defining a recess, so that upon insertion, tensioning and sealing of the at least one strap member, a portion of the at least one strap member is received in the recess, toward precluding extension of the at least one strap member beyond an outwardly facing surface of the second support disk.

* * * * *